United States Patent [19]

Schlobohm

[11] 4,306,584

[45] Dec. 22, 1981

[54] DIAPHRAGM FOR A BREATH-CONTROLLED DOSAGING VALVE

[75] Inventor: Joachim Schlobohm, Oldesloe, Fed. Rep. of Germany

[73] Assignee: Drägerwerk Aktiengesellschaft, Fed. Rep. of Germany

[21] Appl. No.: 92,189

[22] Filed: Nov. 7, 1979

[30] Foreign Application Priority Data

Dec. 1, 1978 [DE] Fed. Rep. of Germany ..... 2852016

[51] Int. Cl.[3] ..... A62B 7/04

[52] U.S. Cl. ..... 137/494; 92/103 F; 92/103 SD; 128/204.26; 137/DIG. 9; 528/421

[58] Field of Search ..... 92/103 F, 103 SD; 137/DIG. 9, 494; 128/204.26; 428/447, 500; 2/7; 528/421

[56] References Cited

U.S. PATENT DOCUMENTS

| | | | |
|---|---|---|---|
| 3,040,762 | 6/1962 | Spiotta | 137/DIG. 9 |
| 3,216,416 | 11/1965 | Mitchell | 137/DIG. 9 |
| 3,384,603 | 5/1968 | Elfers | 528/421 |
| 3,776,863 | 12/1973 | Shibatani | 528/421 |
| 3,874,052 | 4/1975 | Schantz | 92/103 SD |
| 3,956,544 | 5/1976 | Harrington | 428/36 |
| 4,022,114 | 5/1977 | Hansen | 92/103 F |
| 4,142,021 | 2/1979 | Dixon | 528/421 |
| 4,178,961 | 12/1979 | Warncke | 137/DIG. 9 |

FOREIGN PATENT DOCUMENTS

| | | | |
|---|---|---|---|
| 446129 | 1/1948 | Canada | 137/DIG. 9 |
| 1184737 | 3/1970 | United Kingdom | 92/103 F. |

*Primary Examiner*—Abraham Hershkovitz
*Attorney, Agent, or Firm*—McGlew and Tuttle

[57] ABSTRACT

A diaphragm for a dosaging valve in which one side of the diaphragm is exposed to the surrounding environment and the other side is exposed to a respiratory or breathing gas, comprises, a central layer or insert which is coated on both sides and an outer layer overlying the insert and facing the surrounding medium which comprises a silicone elastomer and an inner layer overlying said insert and facing the interior of the housing and exposed to the breathing gas which comprises a polypropylene oxide rubber.

5 Claims, 2 Drawing Figures

Fig. 2
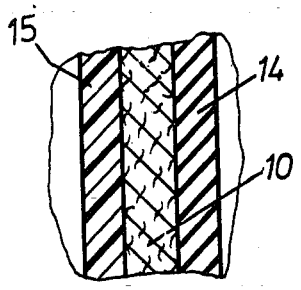
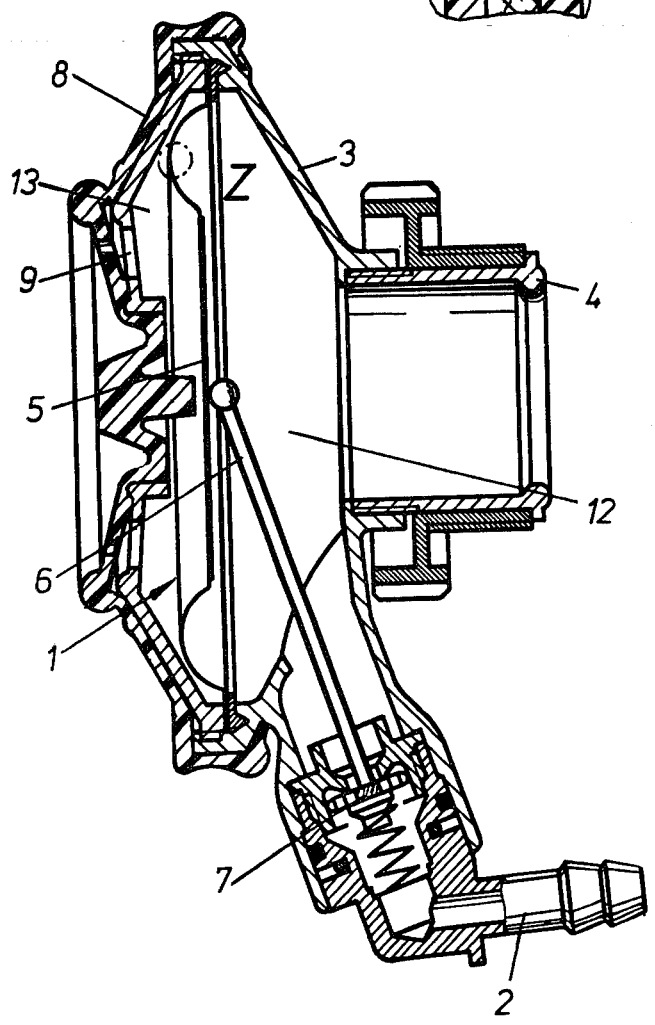
Fig.1

DIAPHRAGM FOR A BREATH-CONTROLLED DOSAGING VALVE

FIELD AND BACKGROUND OF THE INVENTION

This invention relates to the construction of dosaging valves in general and, in particular, to a new and useful diaphragm for a breath-controlled dosaging valve in gas masks and respirators.

Breath-controlled dosaging valves are used in gas maks and respirators. Gas masks protect the wearer against harmful admixtures and lack of oxygen in the air to be inhaled. Respirators serve to enhance breathing or to provide a substitute in case breathing is reduced or stops.

An essential element is a diaphragm which transforms pressure variations into control movements. It is admitted on one side by the possibly aggressively contaminated surrounding atmosphere and, on the inside, by the breathing gas to be controlled. The diaphragm must perform its function within the possible temperature limits of −70° C. to +80° C. This takes into account the fact that the expansion of the breathing gas leads to greater cooling than that corresponding to the ambient temperature. A known pressure gas mask, which is used particularly for gas protection and diving, is equipped with a lung-controlled air supply. In this apparatus, a pressure-sensitive control element with a diaphragm is connected to the breathing gas pipe, which opens or closes the pressure gas supply valve automatically at a certain pressure. The diaphragm shuts off a housing through which the pressure gas current to be inhaled is conducted.

In the center of the diaphragm, a lever is arranged, which is mounted in a bearing inside of the housing. Another lever, which actuates the valve leading to the pressure gas supply bears against this lever. In order to protect the diaphragm against the environment, it is provided with a cover. Bores in the cover establish the pressure connections to the surrounding atmosphere.

The diaphragm moves with the pressure difference between the surrounding air and the pressure in the breathing hose, and thus controls the sealing valve over the levers. The diaphragm is exposed on one side to the possibly aggressively contaminated outside air and, on the other side, to the pressure gas. Data concerning the material of the diaphragm are not given. According to the drawing, it is a one-layer diaphragm. The said diaphragm cannot withstand the aggressiveness of the surrounding atmosphere for too long. In addition, the impermeability to gas is insufficient. The entrained breathing gas supply is thus unnecessarily stressed (See German Pat. No. 959,620.).

SUMMARY OF THE INVENTION

The present invention provides an elastic diaphragm for breath-controlled dosaging valves for use in gas masks and respirators which has great resistance to the aggressive constituents in the surrounding medium in a range between −70° C. and +80° C., which has good flexibility and is impermeable to gas.

In accordance with the invention, there is provided a diaphragm for use in a dosaging valve which includes an insert which is coated on both sides with an outer layer which overlies the insert and faces the surrounding medium and comprises a silicone elastomer, and with an inner layer overlying the insert and facing the interior of the housing, exposed to the breathing gas, which comprises a polypropylene oxide rubber.

An advantage achieved with the invention is that the combination of the materials used for the diaphragm ensures impermeability to gas with good flexibility and, thus, mobility in the temperature range from between −70° C. and +80° C. The selection of the material for the insert permits a further adaptation to specific needs.

Accordingly, an object of the present invention is to provide an improved diaphragm for a breath-controlled dosaging valve in gas masks and respirators, which comprises, an insert coated on both sides with an outer layer overlying the insert and facing the surrounding medium and comprising a silicone elastomer and an inner layer overlying the insert and facing the interior of the housing and exposed to the breathing gas which comprises a polypropylene oxide rubber.

It is a further object of the invention to provide in a breath-controlled dosaging valve of the type having a housing defining a chamber, a diaphragm, flexibly mounted to the housing, extending across the chamber and dividing the chamber into a first compartment open to the atmosphere surrounding the housing and a second compartment, the second compartment having a first connecting socket for connecting the second compartment with a source of breathing gas and a second connecting socket for connecting the second compartment with a breathing circuit, shutter valve means for opening and closing a fluid communication path between the first connecting socket and the second compartment, a connecting lever connecting the diaphragm and and the shutter valve means, and the shutter valve means being operative to open and close the fluid communication path responsive to the movement of the diaphragm, the improvement wherein the diaphragm, which is flexible and impermeable to gas in the temperature range of −70° C. and 80° C., is composed of an insert which is coated on each of its sides, an outer layer overlying the insert adjacent the first compartment and facing the surrounding medium composed of a silicone elastomer material and an inner layer overlying the insert adjacent the second compartment in a gas-type relationship and facing the interior of the housing and exposed to the breathing gas, the inner layer being composed of a polypropylene oxide rubber material.

A further object of the invention is to provide a diaphragm for a breath-controlled dosaging valve which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the Drawing:

FIG. 1 is a transverse sectional view through a dosaging valve constructed in accordance with the present invention; and FIG. 2 is an enlarged detail of the diaphragm shown in FIG. 1.

DESCRIPTION OF THE PREFERRED EMBODIMENT

Referring to the drawing in particular, the invention embodied therein, comprises, a diaphragm for a breath-controlled dosaging valve, generally designated 1, which may be used in gas masks and/or respirators.

The breath-controlled dosaging valve 1 is connected in a known manner by connecting socket 2 to the breathing gas supply, for example, a pressure reducer, in front of a pressure gas bottle. Housing 3 is connected over socket 4 to a breathing hose. Housing 3 is provided with a diaphragm 5, flexibly mounted to the housing, extending across a chamber defined by the housing to divide the chamber into a first and a second compartment. The diaphragm 5 has an interior side facing housing interior compartment on interior 12 and exposed to the pressure of the breathing circuit and, on the exterior chamber or exterior 13, the diaphragm 5 is exposed to the pressure in the surrounding medium. Diaphragm 5 actuates a valve shutter 7 of dosaging valve 1 over control lever 6. Cover 8, with holes 9, protects the diaphragm 5.

As shown in FIG. 2, diaphragm 5 comprises an insert 10 of a fabric which is coated on both sides. The inner layer 14 of the diaphragm facing housing interior 12, hence, the breathing gas, is made of a polypropylene oxide rubber, for example, of parel-elastomer. This material is extremely gastight and remains flexible even at the required low temperatures of −70° C. The outer layer 15, which is exposed to the possibly aggressive surrounding medium, is a silicone-elastomer. The silicone-elastomer ensures the great chemical resistance to the surrounding gases or liquids which is required of this material. The insert 10 may comprise a woven fabric, non-woven fabric or paper.

While a specific embodiment of the invention has been shown and described in detail to illustrate the application of the principles of the invention, it will be understood that the invention may be embodied otherwise without departing from such principles.

What is claimed is:

1. In a breath-controlled dosaging valve for use in gas mask and respirators of the type having a housing defining a chamber, a diaphragm, flexibly mounted to the housing, extending across the chamber and dividing the chamber into a first compartment open to the medium surrounding the housing and a second compartment, the second compartment having a first connecting socket for connecting the second compartment with a source of breathing gas and a second connecting socket for connecting the second compartment with a breathing circuit, shutter valve means for opening and closing a fluid communication path between the first connecting socket and the second compartment, a connecting lever connecting the diaphragm and the shutter valve means, and the shutter valve means being operative to open and close the fluid communication path responsive to the movement of the diaphragm, the improvement wherein the diaphragm is flexible and impermeable to gas in the temperature range of −70° C. and 80° C., and comprises an insert which is coated on each of its sides, an outer layer overlying said insert adjacent the first compartment and facing the surrounding medium comprising a silicone elastomer material, and an inner layer overying said insert adjacent the second compartment in a gas-tight relationship and facing the interior of the housing and exposed to the breathing gas, comprising a polypropylene oxide rubber material.

2. The improvement set forth in claim 1, wherein said insert is a woven fabric.

3. The improvement as set forth in claim 1, wherein said insert is a non-woven fabric.

4. The improvement set forth in claim 1, wherein said insert comprises paper.

5. The improvement set forth in claim 1, wherein said inner layer comprises a parel-elastomer.

* * * * *